343-909 SR
5/7/85 XR 4,516,130

United States Patent [19]

Dragone

[11] Patent Number: 4,516,130

[45] Date of Patent: May 7, 1985

[54] ANTENNA ARRANGEMENTS USING FOCAL PLANE FILTERING FOR REDUCING SIDELOBES

[75] Inventor: Corrado Dragone, Little Silver, N.J.

[73] Assignee: AT&T Bell Laboratories, Murray Hill, N.J.

[21] Appl. No.: 356,386

[22] Filed: Mar. 9, 1982

[51] Int. Cl.[3] ..... H01Q 19/19

[52] U.S. Cl. ..... 343/781 P; 343/909

[58] Field of Search ..... 343/781 P, 781 CA, 840, 343/753, 755, 379, 909

[56] References Cited

U.S. PATENT DOCUMENTS

| | | | |
|---|---|---|---|
| 3,094,695 | 6/1963 | Jahn | 343/100 |
| 3,176,301 | 3/1965 | Wellons et al. | 343/782 |
| 3,202,990 | 8/1965 | Howells | 343/100 |
| 3,325,816 | 6/1967 | Dutton | 343/777 |
| 3,633,208 | 1/1972 | Ajioka | 343/778 |
| 3,704,464 | 11/1972 | Drane, Jr. et al. | 343/100 |
| 3,811,129 | 5/1974 | Holst | 343/844 |
| 3,815,140 | 6/1974 | Buehler et al. | 343/779 |
| 3,983,560 | 9/1976 | MacDougall | 343/781 CA |
| 4,021,812 | 5/1977 | Schell et al. | 343/753 |
| 4,166,276 | 8/1979 | Dragone | 343/781 P |
| 4,169,268 | 9/1979 | Schell et al. | 343/909 |
| 4,187,508 | 2/1980 | Evans | 343/770 |
| 4,223,316 | 9/1980 | Drabowitch | 343/781 P |
| 4,259,674 | 3/1981 | Dragone et al. | 343/753 |
| 4,364,052 | 12/1982 | Ohm | 343/781 P |
| 4,376,940 | 3/1983 | Miedema | 343/840 |

FOREIGN PATENT DOCUMENTS

| | | | |
|---|---|---|---|
| 50-79859 | 6/1975 | Japan | 343/781 P |

OTHER PUBLICATIONS

Parekh, S. V. et al., "Reshaped Subreflectors Reduce Antenna Sidelobes", *Microwaves*, vol. 16, No. 5, 5-77, pp. 170-173.

Mittra, R. et al., "Shaped Dual Reflector Synthesis", *IEEE Newsletter, Antennas and Propagation Society*, vol. 22, No. 4, 8-80, pp. 5-9.

*Primary Examiner*—Eli Lieberman
*Assistant Examiner*—Michael C. Wimer
*Attorney, Agent, or Firm*—Erwin W. Pfeifle

[57] ABSTRACT

The present invention relates to an antenna arrangement comprising a feed producing a predetermined feed aperture illumination and a plurality of sequentially arranged reflectors including a main reflector forming the aperture of the antenna arrangement. The present antenna arrangement also includes filtering means centered on a real focal point between two reflectors of the antenna arrangement. The filtering means is arranged to pass therethrough the central ray of a beam launched by the feed and for smoothing out discontinuities of the image of the feed aperture illumination in the area of the main reflector normally found without filtering. The main reflector is then made slightly oversize to intercept the smoothened-out image of the feed aperture illumination along a line which produces a predetermined level of edge intensity.

3 Claims, 5 Drawing Figures

ANTENNA ARRANGEMENTS USING FOCAL PLANE FILTERING FOR REDUCING SIDELOBES

BACKGROUND OF THE INVENTION

1. Field of the Invention

The present invention relates to antenna arrangements using focal plane filtering to reduce sidelobes and, more particularly, to antenna arrangements including filtering means disposed at a real focal point between two reflectors of the antenna arrangement which passes therethrough the central ray of a beam launched by a feed for smoothing out discontinuities of the image of the feed aperture illumination in the area of the main reflector. The main reflector is then made slightly oversize to intercept the smoothened-out image of the feed aperture illumination along a line which produces a predetermined level of edge intensity.

2. Description of the Prior Art

In radar systems and in terrestrial and satellite communication systems, various techniques have been used to reduce certain sidelobes and in turn the interference therefrom in adjacent links. In receiving systems, undesired sidelobe signals are generally suppressed by receiving the desired signal at a directional antenna and possible interfering signals at a separate omnidirectional antenna. The derived interfering signals are then used to cancel interference in the desired signal using various circuitry configurations. In this regard see, for example, U.S. Pat. Nos. 3,094,695 issued to D. M. Jahn on June 18, 1963 and 3,202,990 issued to P. W. Howells on Aug. 24, 1965. Alternatively, for transmission purposes U.S. Pat. No. 3,704,464 issued to C. J. Drane, Jr. et al on Nov. 28, 1972 discloses a method for maximizing serial directive gain while simultaneously placing nulls in the far-field radiation pattern of an array of N elements which are arbitrarily positioned. The patented method permits specification of directions of up to N-1 independent pattern nulls and/or sidelobes while assertedly providing maximum gain in some prescribed direction. This control is apparently achieved by varying only the amplitude and phase of the element currents in association with a standard gain formula.

U.S. Pat. No. 3,815,140 issued to W. E. Buehler et al on June 4, 1974 relates to a multiple feed arrangement for microwave parabolic antennas which include a parabolic reflector, and a plurality of individual fed illuminators. Each illuminator alone produces a beam of certain dimensions, and by combining the beams through the use of a predetermined configuration of illuminators, including their number and spacing, the physical configuration of the beam, including sidelobes, may be accurately controlled. Furthermore, certain illuminators may be fed by different information sources, thus resulting in a multiple information beam pattern.

It is also known to suppress selected sidelobes in an antenna arrangement comprising a focusing reflector and a feed arrangement by disposing at the feed arrangement or at the focusing reflector at least two sidelobe suppression means comprising either two feeds, two small antennas or sections of the reflective surface of the main reflector. In this regard see, for example, U.S. Pat. application Ser. No. 201,816 filed for E. A. Ohm, now U.S. Pat. Nos. 4,364,052 and 201,822 filed for H. Miedema on Oct. 29, 1980, now U.S. Pat. No. 4,376,940.

A special kind of sidelobes are the grating lobes associated with phased array antenna arrangements. These sidelobes have been reduced to admissible levels by, for example, disposing a filtering means capable of blocking the grating lobes at any real focal point of the antenna arrangement as disclosed in U.S. Pat. No. 4,259,674 issued to C. Dragone et al on Mar. 31, 1981.

The problem remaining in the prior art is to provide a simple technique for illuminating efficiently the aperture of a reflector antenna to provide a predetermined low level of edge intensity at the reflector for reduced sidelobes.

SUMMARY OF THE INVENTION

The foregoing problem has been solved in accordance with the present invention which relates to antenna arrangements using focal plan filtering to reduce sidelobes and, more particularly, to antenna arrangements including filtering means disposed at a real focal point between two reflectors of the antenna arrangement which passes therethrough the central ray of a beam launched by the feed for smoothing out discontinuities of the image of the feed aperture illumination in the area of the main reflector. The main reflector is then made slightly oversize to intercept the smoothened-out image of the feed aperture illumination along a line which produces a predetermined level of edge intensity.

It is an aspect of the present invention to provide an antenna arrangement having substantially reduced sidelobes, comprising a plurality of reflectors arranged in sequence along a feed axis of the arrangement, each reflector comprising a curved focusing reflecting surface and a focal point, where each focal point can be either one of a real and an imaginary form, one of the plurality of reflectors being a main reflector comprising a reflecting surface which forms an aperture of the antenna arrangement. A feed is disposed on an image surface of the aperture of the antenna arrangement and is capable of launching a beam comprising a central ray and including a predetermined feed aperture illumination. A filtering means is disposed at one of the focal points of the plurality of reflectors, which focal point is a real focal point disposed between a pair of sequential reflectors, the filtering means being capable of passing therethrough the central ray launched by the feed and is arranged to produce an image of the feed aperture illumination at the aperture of the antenna arrangement which includes smoothened-out discontinuities at the edge of the image. Finally, the main reflector has a reflecting surface size which in relation to the image of the feed aperture illumination produces a predetermined level of edge intensity.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The present invention relates to a simple technique for illuminating efficiently the aperture of a reflector antenna. As will be described hereinafter, a relatively small feedhorn is combined with an ellipsoid subreflector to obtain a magnified image of the feedhorn aperture. This image is produced over the reflecting surface of a main reflector which has a diameter slightly larger than the image diameter, so that the incident wave is intercepted efficiently with little spill-over by the main reflector. As a consequence, the antenna far-field is approximately a replica, or an image, of the feedhorn far-field over a wide range of frequencies. Very low radiation in the sidelobes can be achieved with such an antenna using a hybrid mode feed. However, such a feed is expensive and difficult to realize with satisfactory input match over a wide bandwidth in excess of an octave. The present invention provides a simple technique for reducing radiation in the sidelobes due to edge diffraction when the feedhorn is a conventional feedhorn with uncorrugated metal walls.

Figure 1:
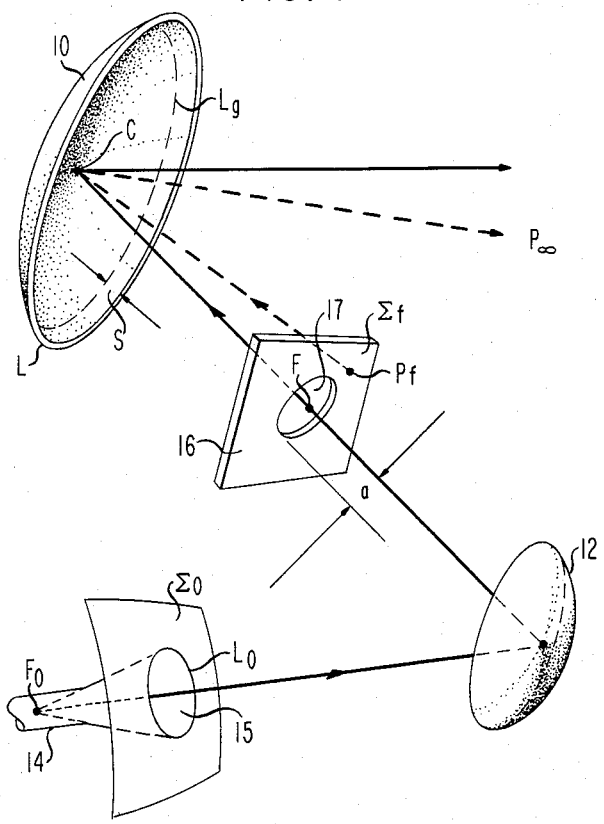
FIG. 1 is a view in perspective of an antenna arrangement in accordance with the present invention including a filtering means and oversized main reflector.

An antenna arrangement for reduced far-field sidelobes in accordance with the present invention is shown in FIG. 1. The present antenna arrangement includes a main reflector 10 which generally is a parabolic reflector with a focal point F; and a subreflector 12 which, for example, can be an elliptical reflector, having a first focal point F and a second focal point $F_0$, which is disposed confocally with main reflector 10 at focal point F. A feedhorn 14, including a predetermined aperture 15 having an edge $L_0$, is disposed with the apex of the feedhorn 14 corresponding to the second focal point $F_0$ of subreflector 12. A filtering means 16 comprising, for example, a metal plate with a small opening of a radius designated "a" is centered on focal point F between main reflector 10 and subreflector 12.

A filtering means was also used in U.S. Pat. No. 4,259,674 issued to C. Dragone et al on Mar. 31, 1981 to suppress grating lobes of a phased array. However, in the present invention the requirements are different since the patented arrangement has a distance between the edge L of main reflector 10 and the image $L_g$ of the feed arrangement formed on main reflector 10 which is approximately zero whereas in the present arrangement there is a finite distance therebetween. In addition, the filter 16 of FIG. 1, when used in a conventional antenna using a feedhorn 14 with a relatively small aperture centered at focal point $F_0$, instead of as in the present arrangement where the apex of the feedhorn 14 is disposed at focal point $F_0$, will in general cause an increase, and not a decrease, of the edge illumination of main reflector 10. In fact, the image of the feedhorn aperture in the conventional antenna appears in the vicinity of focal point F and then maximum aperture efficiency requires a filter or main reflector edge illumination of about 10 dB. Use of a filter 16 with a small aperture similar to the one used in FIG. 1 in the conventional antenna will reduce the effective aperture of the feed image appearing at focal point F and, therefore, it will increase the above edge illumination. As a consequence, it will increase the far-field sidelobes.

In FIG. 1, the image of the aperture 15 of feedhorn 14 directly illuminates main reflector 10. This requires that the edge $L_0$ of the aperture 15 of feedhorn 14 be transformed by the ellipsoid subreflector 12 into an image edge $L_g$ appearing on the parabolic surface of main reflector 10. This image edge $L_g$ can be determined using the well-known lens equation. A property of the illumination of main reflector 10 in the absence of filtering is that it is frequency-independent, to a good approximation. That is, the illumination can be calculated accurately using the laws of geometric optics. Since the illumination is confined inside edge $L_g$, and the diameter $D_g$ of image edge $L_g$ is appreciably smaller than the main reflector diameter D formed by edge L, the main reflector essentially intercepts the entire incident wave. If this requirement is also satisfied with the filtering means 16 taken into account, then the filtering means 16 will cause in the antenna far-field a reduction in amplitude simply given by the filtering means transmittance T. The problem of determining such a filtering means transmittance T that satisfies the above requirement can be solved mathetically for the case of an extremely large, or infinite width, filter aperture. However, such filtering means requires a continuous variation of the transmittance T over the entire focal plane and, therefore, it can only be realized approximately. Then, the antenna far-field can only be an approximate replica of the field in the vicinity of focal point F. The effect of a practical filtering means 16 on the antenna far-field will not be described.

A filtering means 16 of FIG. 1 will first be considered, which arrangement is attractive for its simplicity, since filtering means 16 is simply a metal plate with a small opening 17 centered at the focal point F of main reflector 10. Other forms of filtering means will be described hereinafter. The aperture 15 of feedhorn 14 has its boundary $L_0$ located on a given surface $_0$, and it is assumed that the region inside boundary $L_0$ is illuminated by a spherical wave emanating from focal point $F_0$. The aperture of elliptical subreflector 12 is assumed large enough so that the incident wave radiated by feedhorn 14 is entirely intercepted by subreflector 12, to a good approximation. The purpose of subreflector 12 is to produce on the aperture of main reflector 10 a magnified image of the feed aperture distribution. A property of this image is that if the filtering means 16 is removed then the image becomes frequency-independent, to a good approximation, and it can be calculated using the laws of geometric optics. Thus the image without filtering is confined inside a finite region whose boundary $L_g$ on main reflector 10 is the image of $L_0$.

Figure 2:
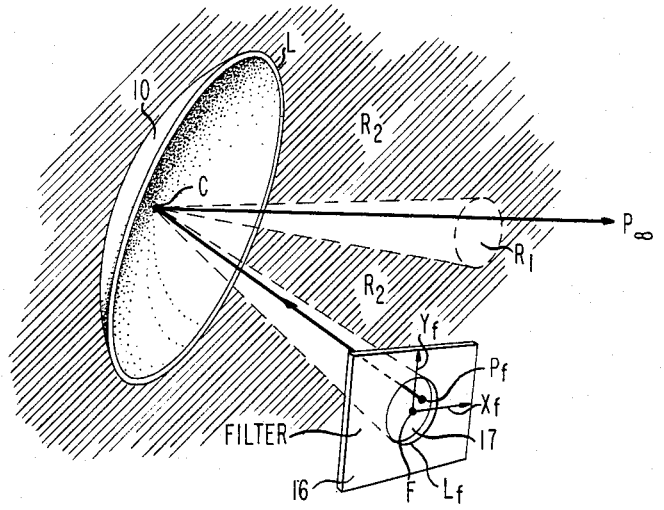
FIG. 2 is a view in perspective of the filtering means and main reflector of FIG. 1 and the relationship between a focal point $P_f$ and the corresponding far-field point $P_\infty$.

The purpose of the filtering means 16 is to modify the field distribution in the vicinity of the focal point F. To better understand how this will affect the far-field it is convenient to assume initially that the main reflector 10 is of infinite aperture. Then, the field produced in the vicinity of the focal point F without filtering is a replica, i.e., the image, of the antenna far-field. More precisely, as shown in FIG. 2, if $P_\infty$ is a point in the far-field and $P_f$ is the corresponding image on a plane $_f$ through focal point F, then the field amplitude radiated in the direction of $P_\infty$ is determined by the field amplitude at $P_f$. This means that if one places in the vicinity of $_f$ a plate with transmission coefficient $T=T(P_f)$, the far-field at $P_\infty$ will be reduced by the coefficient $T(P_f)$.

Suppose, for example, the filtering means 16 is of the type shown in FIG. 1, consisting of a metal plate with a small opening 17 defined by a closed boundary $L_f$. Then in the region inside boundary $L_f$ the value of $T=1$ and, in the outside region the value of $T=0$. If $R_1$ and $R_2$ denote the corresponding regions in the far-field, then the far-field amplitude inside $R_1$ will be little affected by the filtering means, whereas the field amplitude will be virtually reduced to zero in the region $R_2$. Notice that the boundary between the two regions is a conical surface whose generatrix is determined by $L_f$ and, more precisely, it is the image of $L_f$.

In practice, of course, the main reflector 10 cannot be of infinite dimensions. Thus let L be its rim, defining the edge of the antenna aperture. It is clear that if the aperture dimensions are large enough, only the region inside edge L will be illuminated by the wave emanating from the focal region and, therefore, the far-field will differ little from the field obtained with L at $\infty$. Then, it can be shown that the sidelobes in regions $R_2$ will be due primarily to edge diffraction by edge L, and their amplitude will be negligible if the illumination in the vicinity of edge L is negligible.

Figure 3:
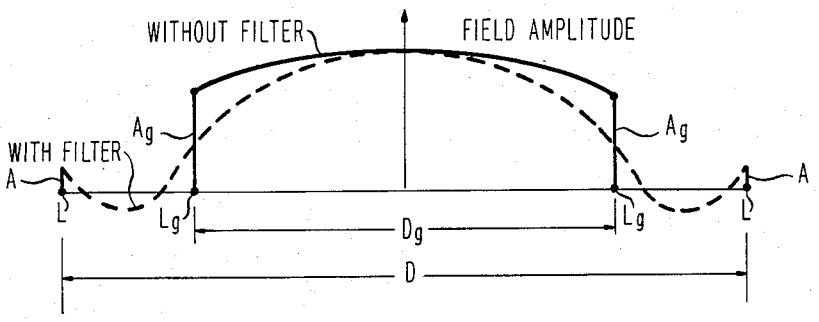
FIG. 3 is a curve of the aperture illumination of the main reflector of FIG. 1 both with and without filtering.

Thus far, for simplicity, the filtering means shown in FIGS. 1 and 2 has been considered whose transmittance is zero in region $R_2$. If instead $T \neq 0$ in region $R_2$, then one must add to the above far-field component due to edge diffraction by rim L a second component representing the far-field which would be produced by an infinitely large reflector. Obviously, the latter component is zero if the transmittance $T_2$ in the area of filtering means 16 covering the region $R_2$ is zero. The former component is determined primarily by the field amplitude A at the rim L of main reflector 10. The effect of the filtering means 16 on the aperture illumination of main reflector 10 is illustrated in FIG. 3. Without filtering, the illumination is zero at the edge L of main reflector 10, but such illumination has a discontinuity at the edge $L_g$ of the image of the feed aperture. However, because of the nonzero edge illumination caused by the filtering means 16 at the edge L of main reflector 10, some edge diffraction will be caused by edge L. It is to be noticed that edge diffraction at $L_g$ without a filtering means 16 is determined by the field amplitude $A_g$ at edge $L_g$. With a filtering means 16, edge diffraction is determined by the field amplitude A at edge L and, therefore, it is reduced by the ratio of $A/A_g$. The ratio $A/A_g$ for the filtering means 16 of FIGS. 1 and 2 will now be determined.

Let s be the separation between the two edges L and $L_g$ on the reflecting surface of main reflector 10, let f be the focal length of parabolic main reflector 10 and let $\lambda$ be the wavelength of the signal being transmitted, and assume that $$\frac{2as}{\lambda f} >> 1. \tag{1}$$

Also let $$V = \pi\left(\frac{D_g}{\lambda}\right)\left(\frac{a}{f}\right), \; S = \frac{2s}{D_g} \tag{2}$$

where $D_g$ is the diameter of edge $L_g$. It can then be shown that $$\frac{A}{A_g} \simeq \frac{1}{\pi}\,\frac{\cos(VS)}{VS}, \tag{3}$$

which gives approximately the reduction, in edge diffraction, caused by the filtering means 16 of FIG. 2. It is to be noted that this ratio depends on the product VS where V is determined by the radius a of the filtering means aperture and by the distance S between the two edges L and $L_g$. Thus a small $A/A_g$ requires a large product VS.

Figure 4:
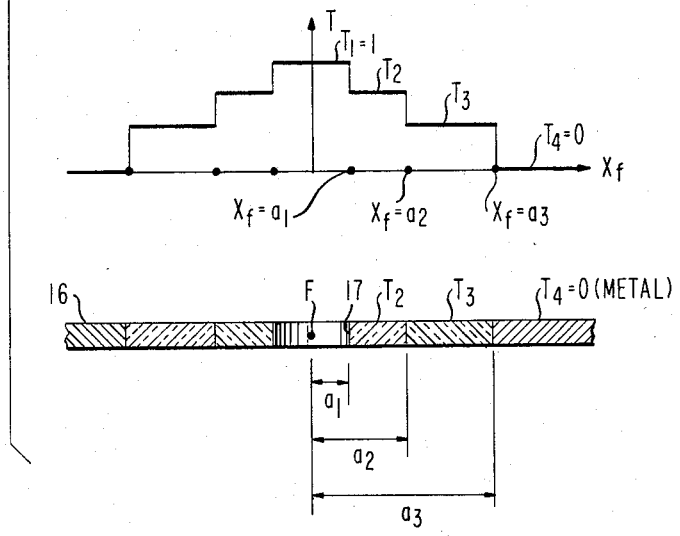
FIG. 4 is a top cross-sectional view of a filtering means for use in the arrangement of FIG. 1 having N sections of different transmittance.

This reduction factor has a strong frequency dependence due to the dependence on the wavelength $\lambda$ of the numerator. This dependence can be greatly reduced by using a filtering means 16 shown in FIG. 4, consisting of N sections, each section characterized by a separate constant value of T. More particularly, in FIG. 4 the center portion centered on focal point F is shown with a radius $a_1$ forming an opening 17 with a transmittance $T_1=1$. The next adjacent section is shown extending radially outward between radius $a_1$ and a radius $a_2$ and comprising a material having a transmittance $T_2$ which is less than $T_1$. The third section is shown extending radially outward between radius $a_2$ and a radius $a_3$ and comprises material with a transmittance $T_3$ which is lower than $T_2$ before encountering a metal plate extending beyond radius $a_3$ having a transmittance $T_4=0$.

With such configuration, then if $T_i$ is the $i^{th}$ value of T there is obtained instead of Equation (3) the expression $$\frac{A}{A_g} \sim \frac{1}{\pi}\sum_{i=1}^{N-1}(T_i - T_{i+1})\frac{\cos(V_iS)}{V_iS}, \tag{4}$$

where $$V_i = \pi\frac{D_g}{\lambda}\,\frac{a_i}{f}. \tag{5}$$

Figure 5:
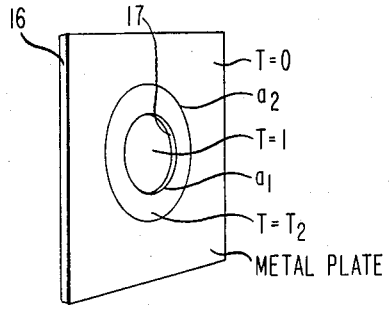
FIG. 5 is a perspective view of a filtering means of FIG. 4 comprising three sections of different transmittance.

Suppose for example that $N=3$ as illustrated in FIG. 5. Then let the last filter section be realized with a metal plate so that $T_3=0$, and let a layer of suitable material be used between radii $a_1$ and $a_2$ so as to obtain the desired value of $T=T_2$. Then, $$\frac{A}{A_g} \sim \frac{1}{\pi S}\left|\frac{1-T_2}{V_1}\cos(V_1S) + \frac{T_2}{V_2}\cos(V_2S)\right| \tag{6}$$

and by choosing a particular wavelength $\lambda=\lambda_0$ the $$(V_2 - V_1)S = \pi \tag{7}$$

$$\frac{T_2}{1-T_1} = \frac{V_2}{V_1} \tag{8}$$

and there is obtained the expression $$\frac{A}{A_g} \sim 1 - T_2\frac{\cos(V_1S) + \cos(V_2S)}{\pi S V_1} \tag{9}$$

Now the numerator remains small over a relatively wide frequency range. From the foregoing discussion, it can be seen that once a particular filtering means 16 has been chosen to provide a predetermined reduction in sidelobes, then the finite distance s that the main reflector is enlarged as shown in FIG. 1 can be determined to provide the required level of edge illumination for reduced sidelobes.

What is claimed is:

1. An antenna arrangement having substantially reduced sidelobes comprising:

a plurality of reflectors arranged confocally in sequence along a feed axis of the arrangement, each reflector comprising a curved focusing reflecting surface and at least one focal point where each focal point can be either one of a real and an imaginary form, one of the plurality of reflectors being a main reflector comprising a reflecting surface which forms an aperture of the antenna arrangement;

a feedhorn capable of launching a spherical beam comprising a central ray from the apex of the feedhorn disposed on a first focal point of the plurality of confocally arranged reflectors, the feedhorn including a predetermined aperture with a predetermined illumination; and a filtering means disposed at one of the focal points of the plurality of reflectors, said one of the focal points being a real focal point disposed between two sequential reflectors, the filtering means being capable of passing therethrough, the central ray launched by the feedhorn for producing an image of the feedhorn aperture illumination at the aperture of the antenna arrangement which includes smoothened-out discontinuities at the edge of the image, said main reflector reflecting surface being oversized with respect to the diameter of the feedhorn image to intersect the image of the feedhorn aperture illumination in a manner to produce a predetermined level of edge intensity, A, as defined by the relationship $A/A_g=F(V,S)$ where $A_g$ is a level of the feedhorn image edge illumination at the main reflector without the inclusion of the filtering means, V is a value of a normalized aperture of the filtering means, S is a value of a normalized increase in the main reflector diameter to generate A, and F is a function which is determined by the response of the filtering means.

2. An antenna arrangement according to claim 1 wherein the filtering means comprises a plate of material having a transmission coefficient T equal to zero and an aperture therethrough centered on said one of the real focal points of the plurality of reflectors having a transmission coefficient equal to one.

3. An antenna arrangement according to claim 2 wherein said filtering means further comprises at least one section of material extending sequentially radially outward between said aperture and the material comprising a transmission coefficient equal to zero, each of said at least one section of material having a separate transmission coefficient between zero and one.

* * * * *